US010053961B2

(12) United States Patent
Wilson et al.

(10) Patent No.: US 10,053,961 B2
(45) Date of Patent: Aug. 21, 2018

(54) DOWNHOLE DEBRIS RETRIEVER

(71) Applicant: Weatherford Technology Holdings, LLC, Houston, TX (US)

(72) Inventors: Timothy L. Wilson, Houston, TX (US); Albert C. Odell, II, Kingwood, TX (US); Simon J. Harrall, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 129 days.

(21) Appl. No.: 14/486,915

(22) Filed: Sep. 15, 2014

(65) Prior Publication Data

US 2015/0075799 A1 Mar. 19, 2015

Related U.S. Application Data

(60) Provisional application No. 61/879,385, filed on Sep. 18, 2013.

(51) Int. Cl.

| | |
|---|---|
| ***E21B 37/08*** | (2006.01) |
| ***E21B 34/10*** | (2006.01) |
| ***E21B 21/00*** | (2006.01) |
| ***E21B 43/08*** | (2006.01) |
| ***E21B 21/10*** | (2006.01) |
| ***E21B 27/00*** | (2006.01) |
| ***E21B 37/00*** | (2006.01) |

(52) U.S. Cl.

CPC ..... *E21B 37/08* (2013.01); *E21B 21/002* (2013.01); *E21B 21/103* (2013.01); *E21B 27/005* (2013.01); *E21B 34/10* (2013.01); *E21B 37/00* (2013.01); *E21B 43/086* (2013.01)

(58) Field of Classification Search

None

See application file for complete search history.

(56) References Cited

U.S. PATENT DOCUMENTS

| | | | | |
|---|---|---|---|---|
| 2,897,897 | A * | 8/1959 | Breukelman | E21B 49/08 166/120 |
| 6,250,387 | B1 | 6/2001 | Carmichael et al. | |
| 6,607,031 | B2 | 8/2003 | Lynde et al. | |
| 7,040,395 | B2 | 5/2006 | Booth | |
| 8,336,617 | B2 | 12/2012 | Knobloch et al. | |
| 2002/0162655 | A1 | 11/2002 | Lynde et al. | |
| 2010/0243258 | A1 | 9/2010 | Fishbeck et al. | |

(Continued)

OTHER PUBLICATIONS

Australian Patent Examination Report dated Jun. 9, 2016, for Australian Patent Application No. 2014321470.

(Continued)

*Primary Examiner* — Caroline N Butcher

(74) *Attorney, Agent, or Firm* — Patterson + Sheridan, LLP

(57) ABSTRACT

A method and apparatus for removing debris from a wellbore using a cleaning tool. The tool may comprise an inner mandrel and a cup member coupled to the inner mandrel. The cup member is moveable between a collapsed position where fluid may flow across the exterior of the cup member, and an extended position where fluid is diverted into a flow path disposed between the inner mandrel and the cup member. The fluid is diverted through a filter member that is coupled to the inner mandrel below the cup member.

24 Claims, 12 Drawing Sheets

(56) References Cited

U.S. PATENT DOCUMENTS

| | | | | |
|---|---|---|---|---|
| 2010/0258301 | A1* | 10/2010 | Bonner | E21B 43/084 166/230 |
| 2013/0168091 | A1 | 7/2013 | Xu et al. | |
| 2014/0374111 | A1* | 12/2014 | Xu | E21B 27/005 166/311 |

OTHER PUBLICATIONS

International Search Report and Written Opinion, dated Apr. 1, 2015, International Application No. PCT/US2014/055864.
United Kingdom Examination Report dated Sep. 14, 2016, for UK Patent Application No. GB1604087.5.
Australian Examination Report dated Jan. 5, 2017, for Australian Patent Application No. 2014321470.

* cited by examiner

DOWNHOLE DEBRIS RETRIEVER

CROSS-REFERENCE TO RELATED APPLICATIONS

This application claims benefit of U.S. Provisional Patent Application Ser. No. 61/879,385, filed Sep. 18, 2013, which application is incorporated herein by reference in its entirety.

BACKGROUND OF THE INVENTION

Field of the Invention

Embodiments of the invention relate to a downhole tool for collecting and removing debris from a wellbore.

Description of the Related Art

When drilling for oil and gas, it is often desired to remove debris, such as rocks, cement particles, metal cuttings, etc., that may become suspended in the wellbore during the drilling operation. Such debris in the wellbore can potentially disrupt subsequent wellbore operations during which tools are run-in and actuated downhole. Therefore, wellbore cleaning tools, such as scrapers and circulation devices, are usually lowered into the wellbore for conducting a cleaning operation to help remove any debris.

The wellbore cleaning tools are used to dislodge debris stuck to the wellbore walls, and circulate cleaning fluids to flush out the debris from the wellbore. However, due to the depth of the wellbore and the size/weight of the debris (as a couple of examples), some debris may remain suspended in the wellbore after a cleaning operation. Also, the removal of the wellbore cleaning tool from the wellbore may cause additional debris to become suspended in the wellbore.

Therefore, there is a need for more effective wellbore cleaning tools to remove debris from wellbores.

SUMMARY OF THE INVENTION

In one embodiment, a wellbore cleaning tool comprises an inner mandrel; a cup member coupled to the inner mandrel, wherein the cup member is moveable between a collapsed position where fluid may flow across the exterior of the cup member, and an extended position where fluid is diverted into a first flow path disposed between the inner mandrel and the cup member; and a filter member coupled to the inner mandrel below the cup member.

In one embodiment, a method of removing debris from a fluid in a wellbore using a wellbore cleaning tool comprises positioning the tool within the wellbore, wherein the fluid is disposed in a flow path formed between an exterior of the tool and the wellbore; flowing the fluid towards a cup member of the tool or moving the cup member through the fluid; allowing the fluid to flow or move across an exterior of the cup member when the fluid flows toward or is encountered by a bottom end of the cup member; preventing the fluid from flowing or moving across the exterior of the cup member when the fluid flows toward or is encountered by a top end of the cup member; and diverting the fluid disposed above the cup member into the interior of the cup member and through a filter member of the tool to remove debris from the fluid.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention comprise a wellbore cleaning tool. The tool may comprise and/or be connected to a work string that comprises other wellbore cleaning tools, such as scrappers and brushes. The tool is configured to circulate a cleaning fluid into the wellbore to pump debris upward past the tool and out of the wellbore. The tool is also configured to form a barrier with the wellbore that diverts the column of fluid above the tool through a filter to capture any remaining debris suspended in the wellbore when pulling the tool out of the wellbore. The tool is equipped with a pressure relief mechanism to prevent excessive swab, surge pressure, and/or over-pressurizing the tool.

Figure 1A:
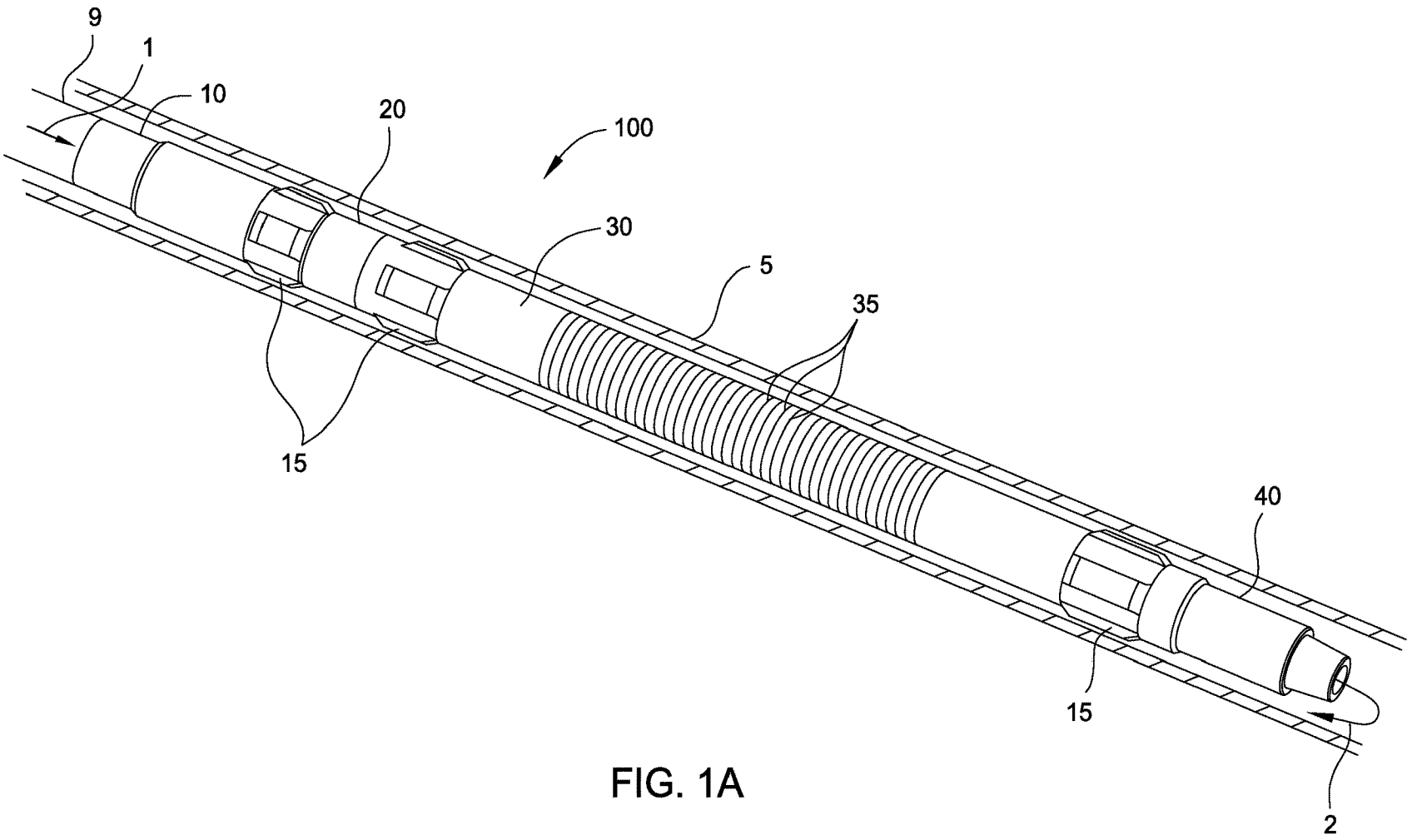
FIGS. 1A and 1B illustrate a downhole tool according to one embodiment.
Figure 1B:
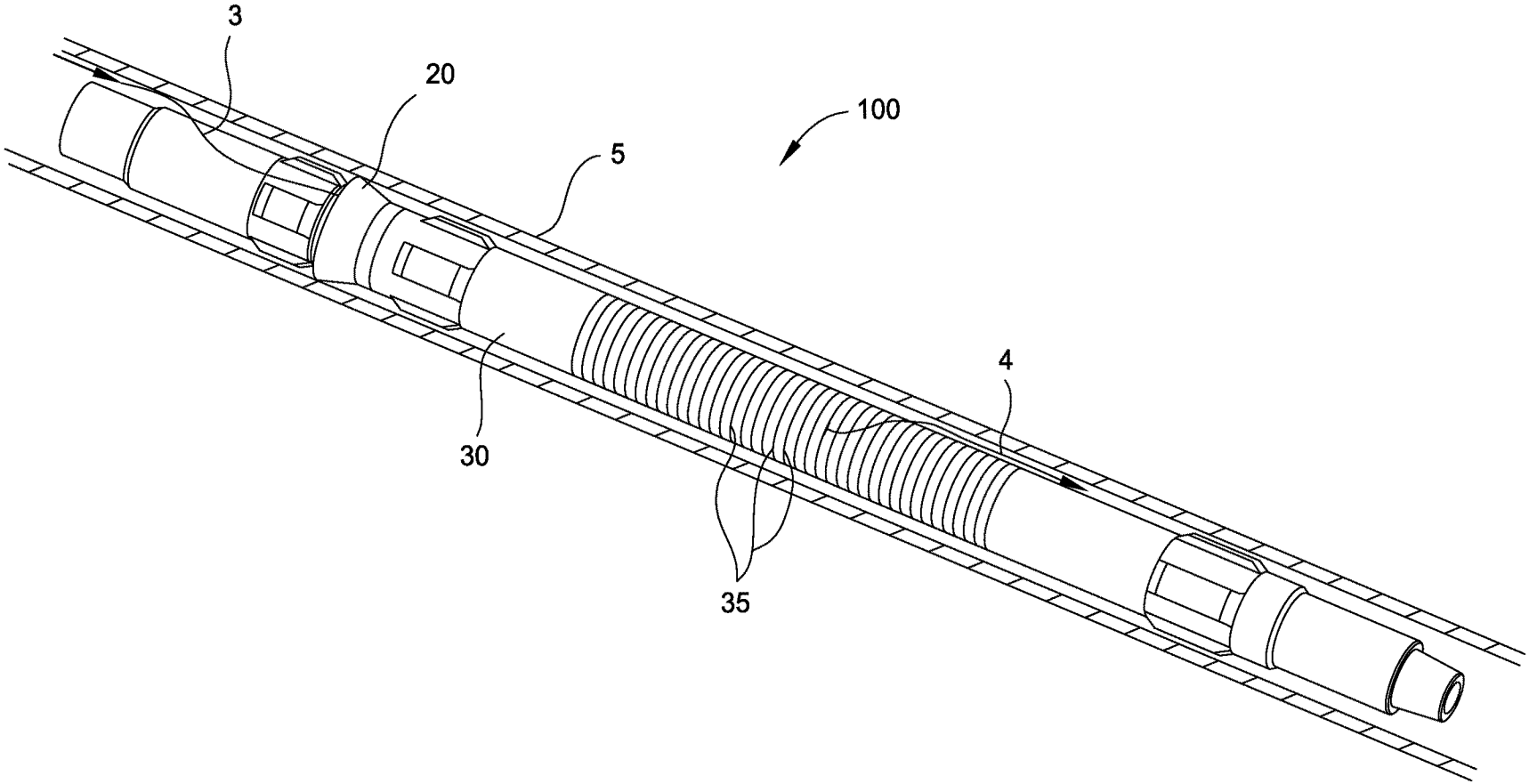

FIGS. 1A and 1B illustrate a wellbore cleaning tool 100 according to one embodiment. The tool 100 may be lowered into a casing 5, or other tubular member, disposed within a wellbore. Although the tool 100 is illustrated within a casing 5, the tool 100 may be used within an open hole, un-cased wellbore. The tool 100 may be coupled to a work string 9 for lowering the tool 100 into and pulling the tool 100 out of the wellbore.

The tool 100 may comprise a top sub 10, one or more centralizers 15, a cup member 20, a filter member 30, and a bottom sub 40. The components of the tool 100 may be coupled together using threaded, welded, and/or sealed connections, and/or other connections types known in the art. One or more of the components of the tool 100 may be formed integrally with one or more other components of the tool 100.

The top sub 10 may be coupled to the work string 9 at an upper end, and may be coupled to a centralizer 15 at the opposite end. The bottom sub 40 may be coupled to a centralizer 15 below the filter member 30. The centralizers 15 may be configured to maintain the tool 100 within the center of the casing 5 and/or the wellbore. In one embodiment, the centralizers 15 may comprise scrappers or brushes configured to dislodge debris from the walls of the casing 5 and/or the wellbore.

The cup member 20 may be disposed between two centralizers 15, adjacent the top sub 10. The cup member 20 may be formed from a flexible type of material, such as rubber, that can flex radially inward and/or outward using pressurized fluid. The cup member 20 may be moved between a collapsed position and an extended position. In the collapsed position, fluid may move past the exterior of the cup member 20. In the extended position, fluid may be obstructed from moving past the exterior of the cup member 20, but may be diverted to flow through the interior of the cup member 20.

Fluid flowing or encountering the cup member 20 in the direction illustrated by reference arrow 2 in FIG. 1A (e.g. upward from the bottom end of the cup member 20) may force the cup member 20 radially inward into the collapsed position such that the fluid may move across the exterior of the cup member 20. In one embodiment, the cup member 20 may be biased inward into the collapsed position such that fluid may move across the exterior of the cup member 20 when approaching from the bottom end of the cup member 20. In one embodiment, the cup member 20 may be moved into the collapsed position using pressurized fluid, a biasing member, and/or any other actuation mechanism known in the art.

Fluid flowing or encountering the cup member 20 in the direction illustrated by reference arrow 3 in FIG. 1B (e.g. downward from the top end of the cup member 20) may force the cup member 20 radially outward into the extended position and into engagement with the casing 5 such that the fluid may not move across the exterior of the cup member 20, and/or may be diverted into the interior of the tool 100. In one embodiment, the cup member 20 may be biased outward into the extended position such that fluid is obstructed from moving across the exterior of the cup member 20 when approaching from the top end of the cup member 20. In one embodiment, the cup member 20 may be moved into the extended position using pressurized fluid, a biasing member, and/or any other actuation mechanism known in the art.

When in the extended position, upper end of the cup member 20 may flex outward into engagement with the interior of the casing 5 and/or the wellbore. A sealed engagement may be formed between the cup member 20 and the interior of the casing 5 and/or the wellbore. The cup member 20 may be configured to divert substantially all of the fluid above the cup member 20 into the interior of the tool 100.

The cup member 20 may include an outer diameter that is greater than or substantially equal to the inner diameter of the casing 5. The cup member 20 remains in contact with the wall of the casing 5 (such as when in an extended position) to prevent fluid from above from moving across the exterior of the cup member 20, and to divert the fluid into the interior of the tool 100. Fluid flowing toward or encountering the bottom end of the cup member 20 may force the cup member 20 to flex radially inward (such as when in a collapsed position) to allow passage of the fluid.

In one embodiment, the cup member 20 may include an outer diameter that is less than the inner diameter of the casing 5. The cup member 20 may not contact the wall of the casing 5 (such as when in a collapsed position), and may allow fluid from below to flow across the exterior of the cup member 20. However, fluid flowing toward or encountering from the top end of the cup member 20 may force the cup member 20 to flex radially outward into engagement with the wall of the casing 5 (such as when in an extended position) to prevent the fluid from above from moving across the exterior of the cup member 20, and to divert the fluid into the interior of the tool 100.

Fluid diverted by the cup member 20 is directed into the interior of the tool 100 for filtering by the filter member 30. The filter member 30 may be disposed between two centralizers 15, below the cup member 20, and may include one or more openings 35 for filtering debris from fluid flowing through the openings 35. Fluid that is diverted into the interior of the tool 100 (illustrated by reference arrow 3 in FIG. 1B) is subsequently directed out of the tool 100 through the openings 35 of the filter member 30 (illustrated by reference arrow 4 in FIG. 1B).

Figure 2:
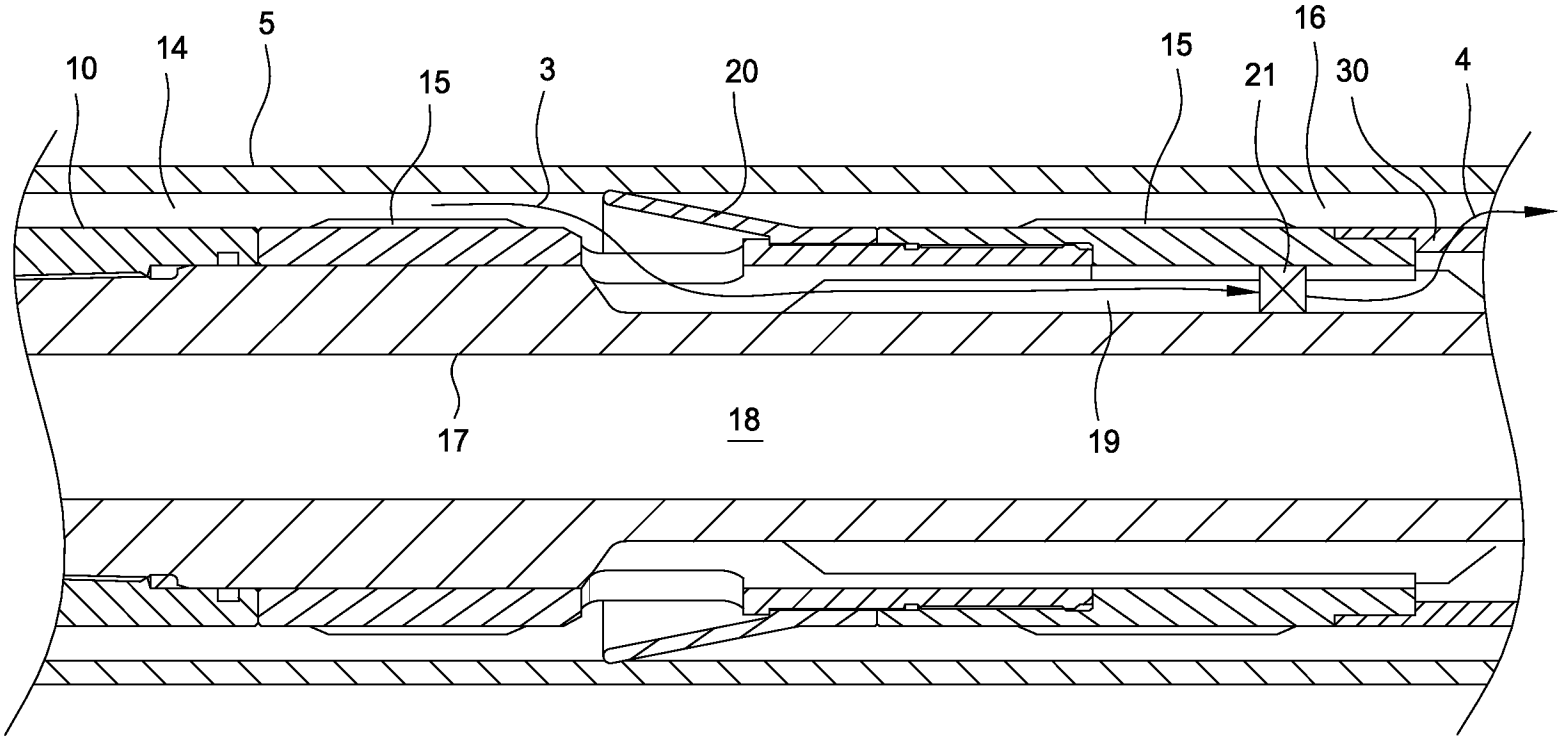
FIG. 2 illustrates a partial sectional view of the downhole tool according to one embodiment.

As illustrated in FIG. 2, the tool 100 may further comprise an inner mandrel 17 coupled to and/or disposed through the top sub 10, the centralizers 15, the cup member 20, the filter member 30, and/or the bottom sub 40. The inner mandrel 17 comprises a flow bore 18 disposed through the tool 100. One or more flow paths 14 are formed between the exterior of the tool 100 and the surrounding casing 5, above the cup member 20. One or more flow paths 19 are formed between the exterior of the inner mandrel 17 and the interior of at least one of the centralizers 15, the cup member 20, and the filter member 30. One or more flow paths 16 are formed between the exterior of the tool 100 and the surrounding casing 5, below the cup member 20. Fluid in the flow paths 14 is diverted into the flow paths 19 by the cup member 20, and then directed out into the flow paths 16 through the filter member 30.

Referring to FIG. 2, the cup member 20 is illustrated in the extended position, where the upper end of the cup member 20 is extended radially outward into engagement with the interior of the casing 5. The cup member 20 diverts fluid, illustrated by reference arrow 3, into the flow paths 19, which direct the fluid into the interior of the filter member 30. Debris in the fluid may be filtered as the fluid flows out of the tool 100 through the openings 35 of the filter member 30 illustrated by reference arrow 4. Debris may be collected and retained within the area between the exterior of the inner mandrel 17 and the interior of the filter member 30. One or more internal check valves 21, such as flapper valves, may be disposed in the flow paths 19 to prevent fluid from backwashing through the filter member 30, such as when circulating fluid up the annulus to the surface.

According to one operation, a cleaning fluid indicated by reference arrow 1 in FIG. 1A may be supplied from the surface to the tool 100 via the work string 9. The cleaning fluid may flow through the flow bore 18 of the inner mandrel 17, and may exit out the end of the tool 100 and/or out any other tools or tubular members connected below the tool 100. As indicated by reference arrow 2 in FIG. 1A, the cleaning fluid and/or any other wellbore fluids may be circulated back up to the surface, through the annulus formed between the exterior of the tool 100 and the interior of the casing 5, to flush out and remove debris suspended in the wellbore. The cup member 20 is in the collapsed position to allow fluid to move past the exterior of the cup member 20 and up to the surface. The check valves 21 prevent the fluid from flowing back up through the interior of the cup member 20.

After circulating the cleaning fluid, the tool 100 may be pulled out of the wellbore and back to the surface. When pulling the tool 100 out of the wellbore, the cup member 20 may be in the extended position to divert the column of fluid in flow paths 14 above the cup member 20 into the flow paths 19, through the filter member 30, and back out into fluid paths 16 below the cup member 20. The tool 100 is thus configured to remove debris from the fluid while being removed from the wellbore.

FIGS. 3A-3D illustrate a wellbore cleaning tool 200 according to one embodiment. The operation of the tool 200 is similar to the operation of the tool 100. The embodiments of the tool 200 may be used in combination with the embodiments of the tool 100, and vice versa. The components of the tool 200 may be coupled together using threaded, welded, and/or sealed connections, and/or other connections types known in the art. One or more of the components of the tool 200 may be formed integrally with one or more other components of the tool 200. The tool 200 may be lowered into and pulled out of a wellbore using a work string 209.

Figure 3A:
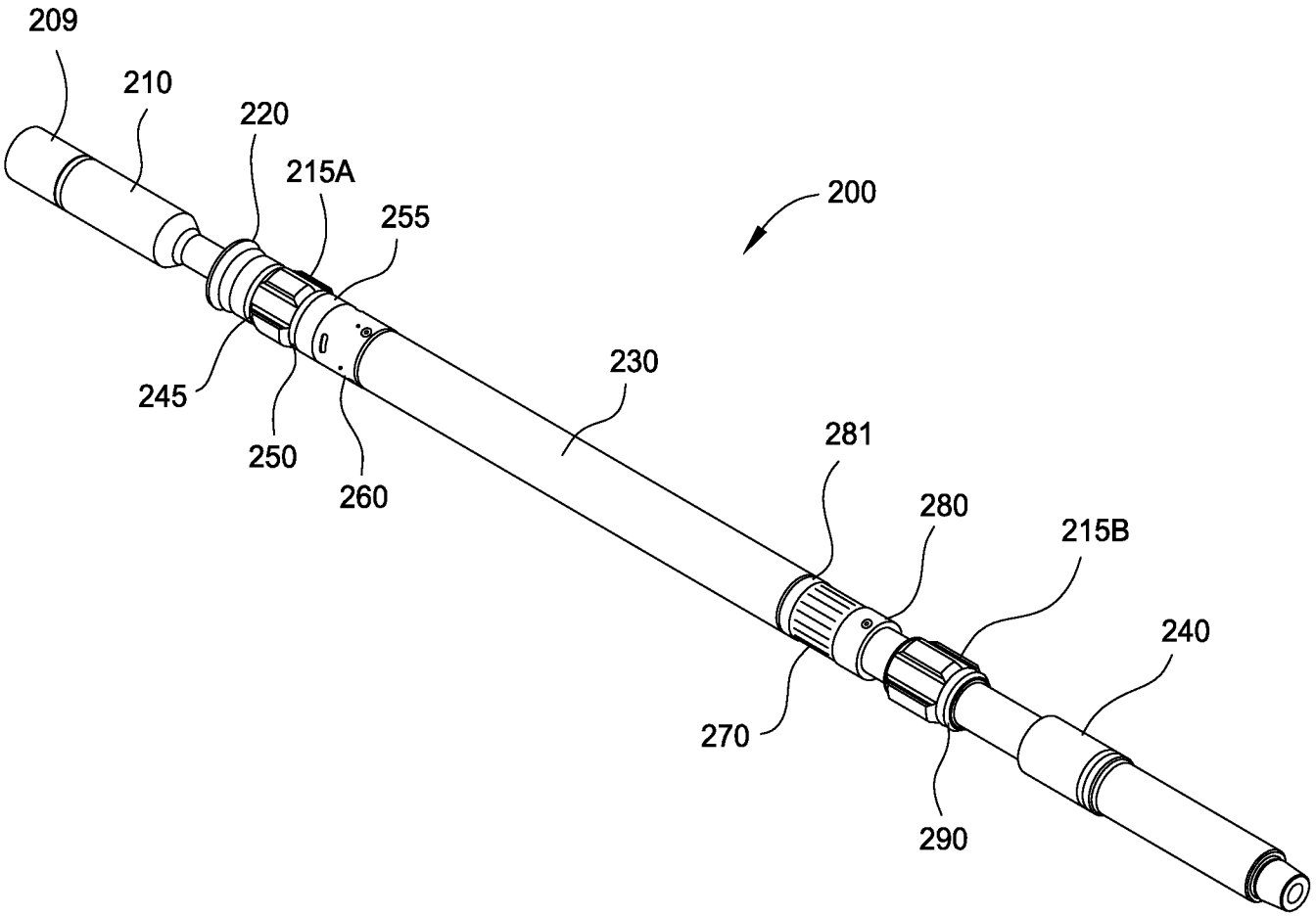
FIGS. 3A-3D illustrate another downhole tool according to one embodiment.
Figure 3C:
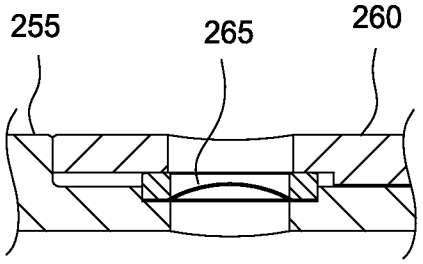
Figure 3B:
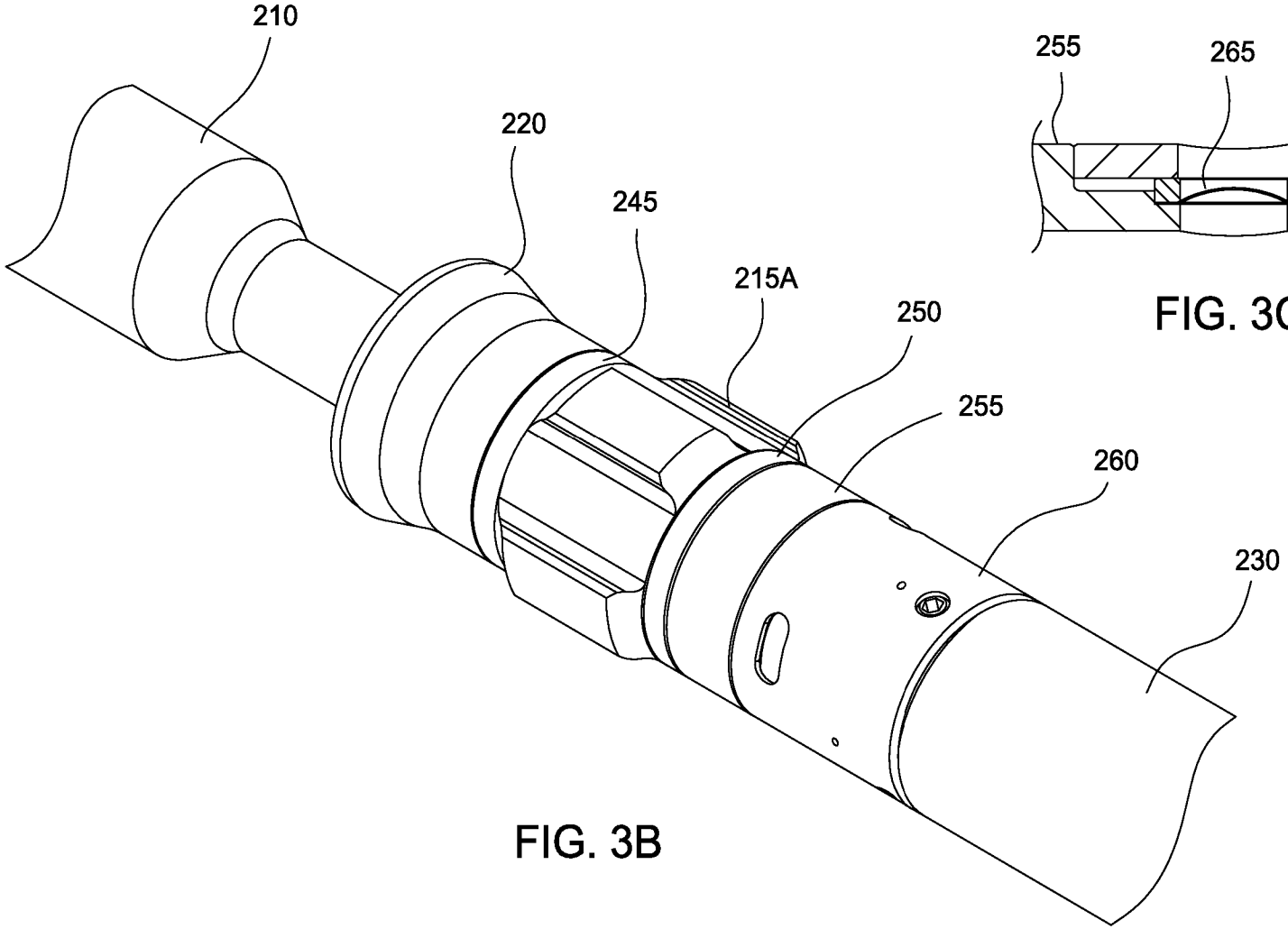
Figure 3D:
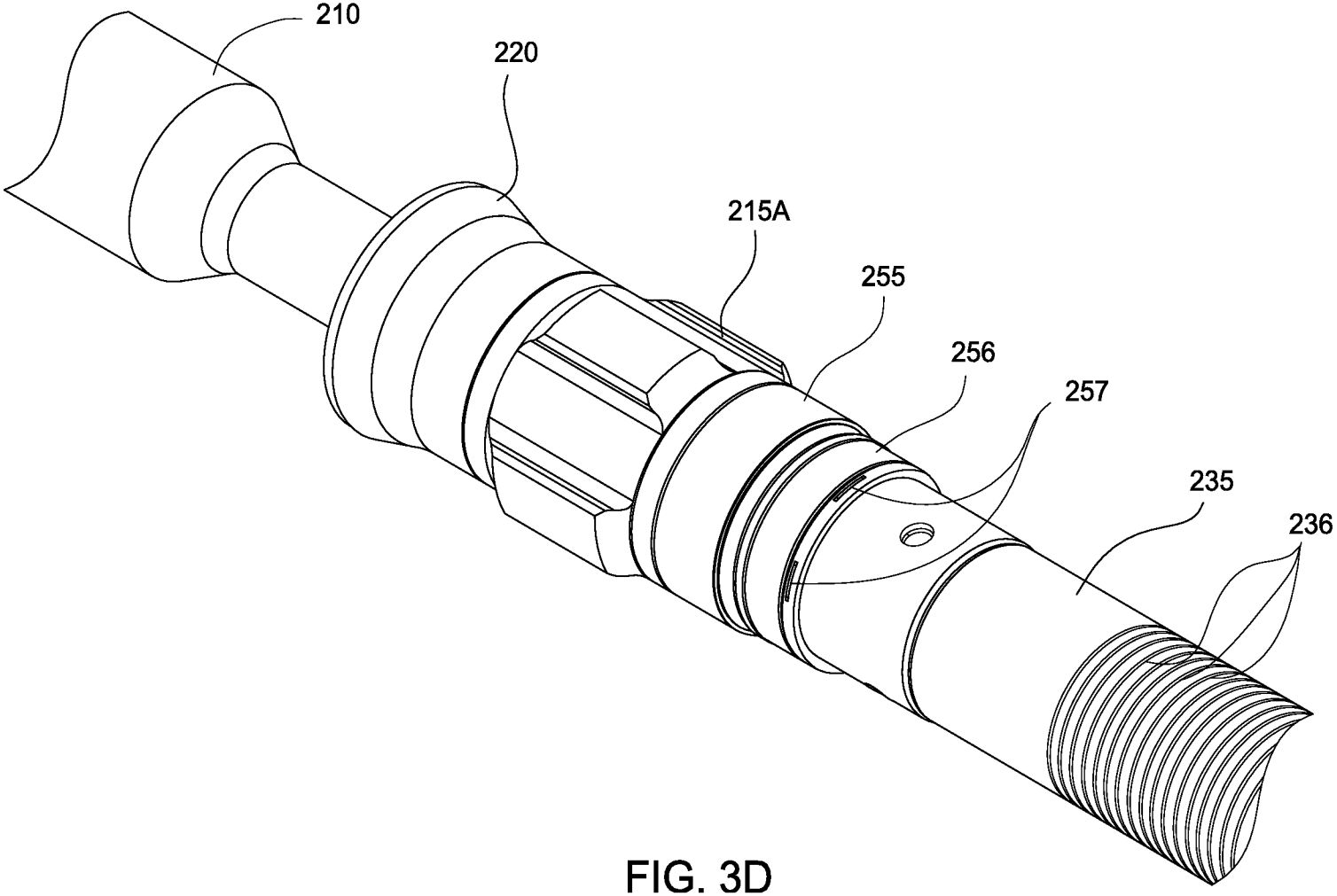

Referring to FIGS. 3A and 3B, the tool 200 may comprise an inner mandrel 210, a cup member 220, an upper centralizer 215A, an upper bearing member 245, a lower bearing member 250, a bypass seat 255, a bypass housing 260, a filter housing 230, a support member 281, a flexible baffle 270, a plug member 280, a lower centralizer 215B, a bearing assembly 290, and a bottom sub 240. Referring to FIG. 3C, the tool 200 may further comprise one or more rupture disks disposed between the bypass seat 255 and the bypass housing 260. Referring to FIG. 3D, the bypass housing 260 and the filter housing 230 have been removed for clarity to illustrate that the tool 200 may further comprise a piston 256, one or more shearable members 257 (such as shear pins), and a filter member 235 having one or more openings 236.

The operation of the tool 200 is similar to the tool 100 in that a cleaning fluid may be supplied through a flow bore 211 (illustrated in FIGS. 4A and 4B) of the inner mandrel 210 and out the end of the tool 200 into the surrounding casing and/or wellbore, and then circulated back up to the surface through the annulus formed between the exterior of the tool 200 and the surrounding casing 5 and/or wellbore. This cleaning operation may be conducted to remove debris suspended in the wellbore. The cup member 220 may operate similar to the cup member 20 by allowing fluid to move across the exterior of the cup member 200 when flowing or encountering the cup member 220 from the bottom end. The cup member 220 may be in the collapsed position when lowering the tool 200 into the wellbore and/or when circulating fluid back to the surface, as described above with respect to the cup member 20.

When pulling the tool 200 out of the wellbore and/or when pumping fluid down the annulus, the column of fluid above the cup member 220 may be diverted into the interior of the tool 200. As described above with respect to the cup member 20, the cup member 220 may be in the extended position when pulling the tool 200 out of the wellbore and/or when pumping fluid down the annulus from the surface. The fluid is directed through the filter member 235 and back out into the wellbore to capture and remove any remaining debris in the fluid.

Figure 4A:
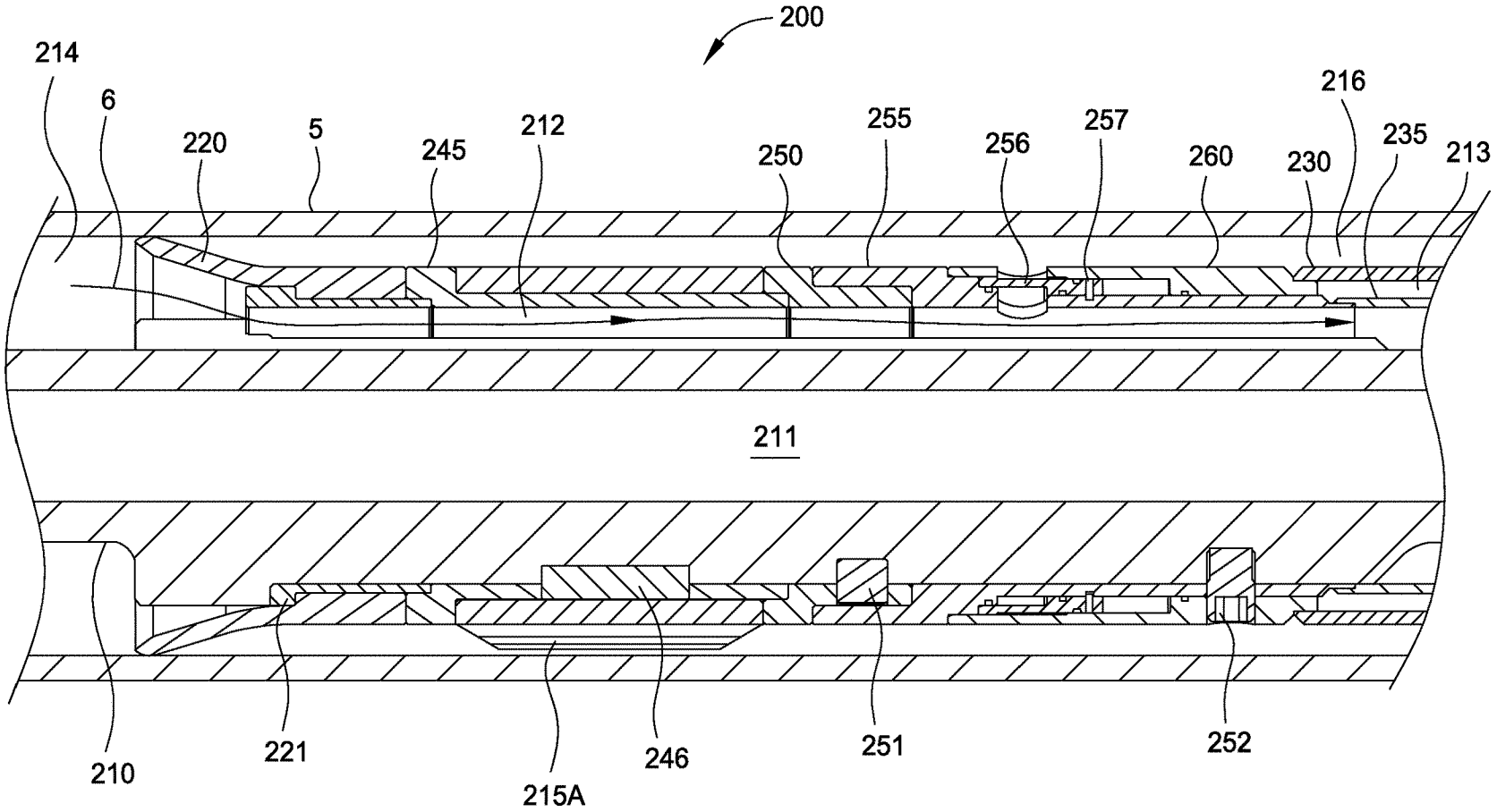
FIGS. 4A and 4B illustrate partial sectional views of the downhole tool according to one embodiment.

Referring to FIG. 4A, the cup member 220 is illustrated in the extended position and in engagement with the casing 5. Fluid in one or more flow paths 214 is diverted into one or more flow paths 212 of the tool 200 as shown by reference arrow 6. The fluid paths 214 may be formed between the exterior of the tool 200 and the surrounding casing 5, above the cup member 220. As illustrated, the cup member 220 is coupled to a bearing 221, which is coupled to and supported by the upper bearing member 245. The upper bearing member 245 supports the upper centralizer 215A and is coupled to the inner mandrel 210 by one or more pin members 246, such as torque pins. The lower bearing member 250 supports the bottom end of the upper centralizer 215A, and is coupled to the inner mandrel 210 by one or more pin members 251, such as thrust pins.

The bypass seat 255 is coupled to the lower bearing member 250 and the bypass housing 260. A pin member 252, such as a set screw, may be disposed through the bypass housing 260, the bypass seat 255, and the inner mandrel 210. The piston 256 may be disposed between the bypass seat 255 and the bypass housing 260. The piston 256 may be releasably coupled to the bypass seat 255 by one or more shearable members 257. One or more seals may be disposed between the bypass seat 255, the piston 256, and the bypass housing 260. The piston 256 may be configured to operate as a pressure relieve valve as further described below.

Figure 4B:
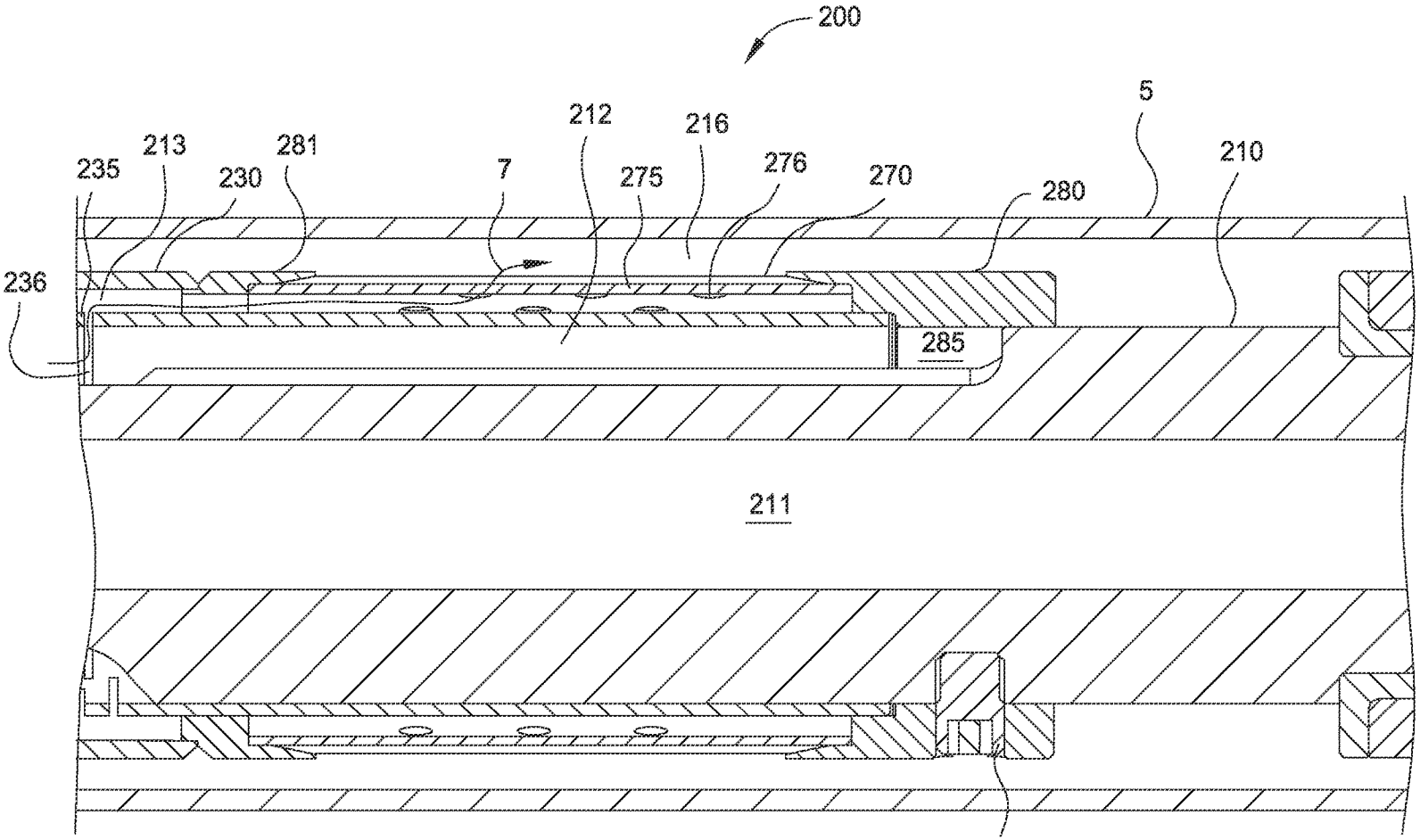

Referring to FIGS. 4A and 4B, the filter housing 230 may be coupled to the bypass housing 260 at one end, and may be coupled to the support member 281 at the opposite end. The filter housing may enclose the filter member 235. The filter member 235 may be coupled to the bypass seat 255 at one end, and may be coupled to the plug member 280 at the opposite end. The plug member 280 may be coupled to the inner mandrel 210 by a pin member 253, such as a set screw, and/or by a threaded connection such that the plug member 280 is screwed onto the inner mandrel 210. The flexible baffle 270 may be coupled to a support mandrel 275, each of which is supported at opposite ends by the support member 281 and the plug member 280. The support member 281 and/or the plug member 280 may comprise internal tapered ends to trap and compress the flexible baffle 270 into a sealed engagement.

Figure 5:
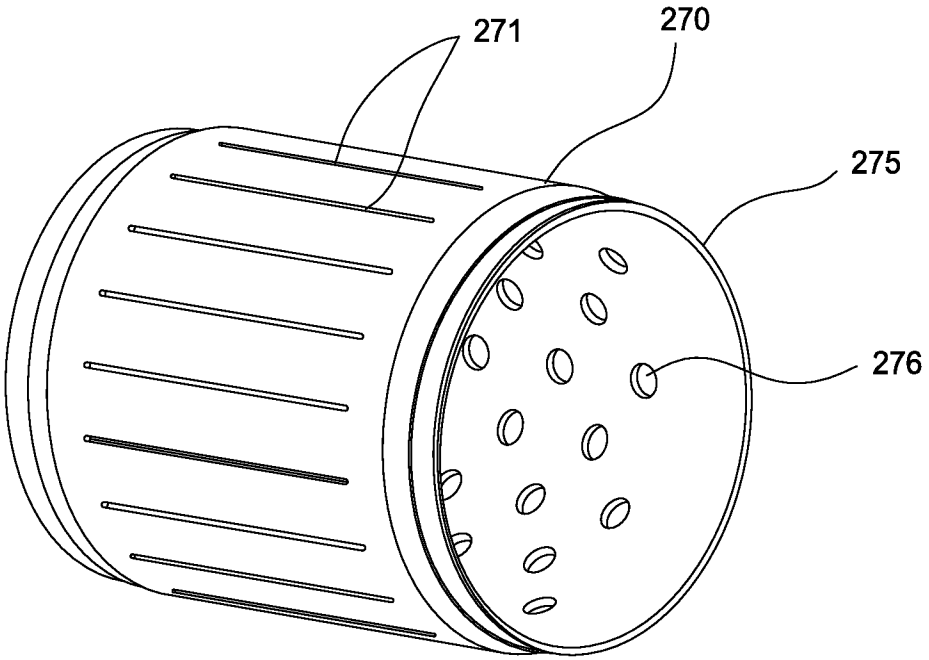
FIG. 5 illustrates a component of the downhole tool according to one embodiment.

As illustrated in FIG. 5, the flexible baffle 270 may include one or more openings 271, such as holes and/or longitudinal slots, disposed about its circumference. The support mandrel 275 may include one or more openings 276, such as a plurality of holes, disposed about its circumference. The support mandrel 275 may be formed form a metallic material, and the flexible baffle 270 may be formed from a flexible material, such as rubber. The support mandrel 275 may be inserted into the flexible baffle 270 to form a substantially sealed interface, and such that the openings 271 in the flexible baffle 270 are offset from the openings 276 in the support mandrel 275. The ends of the flexible baffle 270 may be attached to the support mandrel 275 by means such as gluing to form a seal on the ends of the flexible baffle 270 (as an alternative or in addition to the tapered ends of the plug member 280 and/or the support member 281).

The flexible baffle 270 and the support mandrel 275 are configured to operate as a check valve to permit fluid flow out from the interior of the tool 200 while preventing fluid flow into the interior of the tool 200. In particular, fluid may flow through the openings 276 in the support mandrel 275 and may flex, such as lift, the flexible baffle 270 from the interior so that the fluid can flow out through the openings 271. Fluid may be prevented from flowing into the openings 276 of the support mandrel 275 since the openings 271 of the flexible baffle 270 are not aligned with the openings 276 and since the flexible baffle 270 forms a substantially sealed fit about the support mandrel 275.

Referring back to FIGS. 4A and 4B, fluid in the flow paths 214 may be diverted into the one or more flow paths 212. The flow paths 212 may be formed between the exterior of the inner mandrel 210 and the interior of the surrounding adjacent components, including but not limited to the cup member 20, the bearing 221, the upper bearing member 245, the lower bearing member 250, the bypass seat 255, and the filter member 235. The flow paths 212 may extend along the length of the tool 200 and may terminate in a debris collection area 285, which may be formed by the filter member 235, the plug member 280, and an outer shoulder of the inner mandrel 210. Debris that is filtered out by the filter member 235 may accumulate in the debris collection area 285 and/or along the length of the flow paths 212.

One or more flow paths 213 may be formed between the filter housing 230 and the filter member 235. Fluid may flow from the flow paths 212 to the flow paths 213 via the openings 236 in the filter member 230. The openings 236 in the filter member 235 are sized to substantially prevent debris from passing through the openings 236. Debris that is retained within the filter member 235 may accumulate in the debris collection area 285. The filtered fluid flowing through the flow paths 213 may flow out of the tool 200 through the openings 276 of the support member 270 and the openings 271 of the flexible baffle 270 as illustrated by reference arrow 7 in FIG. 4B. Fluid flowing out of the openings 276 may force, such as lift, at least a portion of the flexible baffle 270 radially outward to allow the fluid to flow out through the openings 271. The filtered fluid flows out into one or more flow paths 216 formed between the exterior of the tool 200 and the surrounding casing 5, below the cup member 220.

Figure 6A:
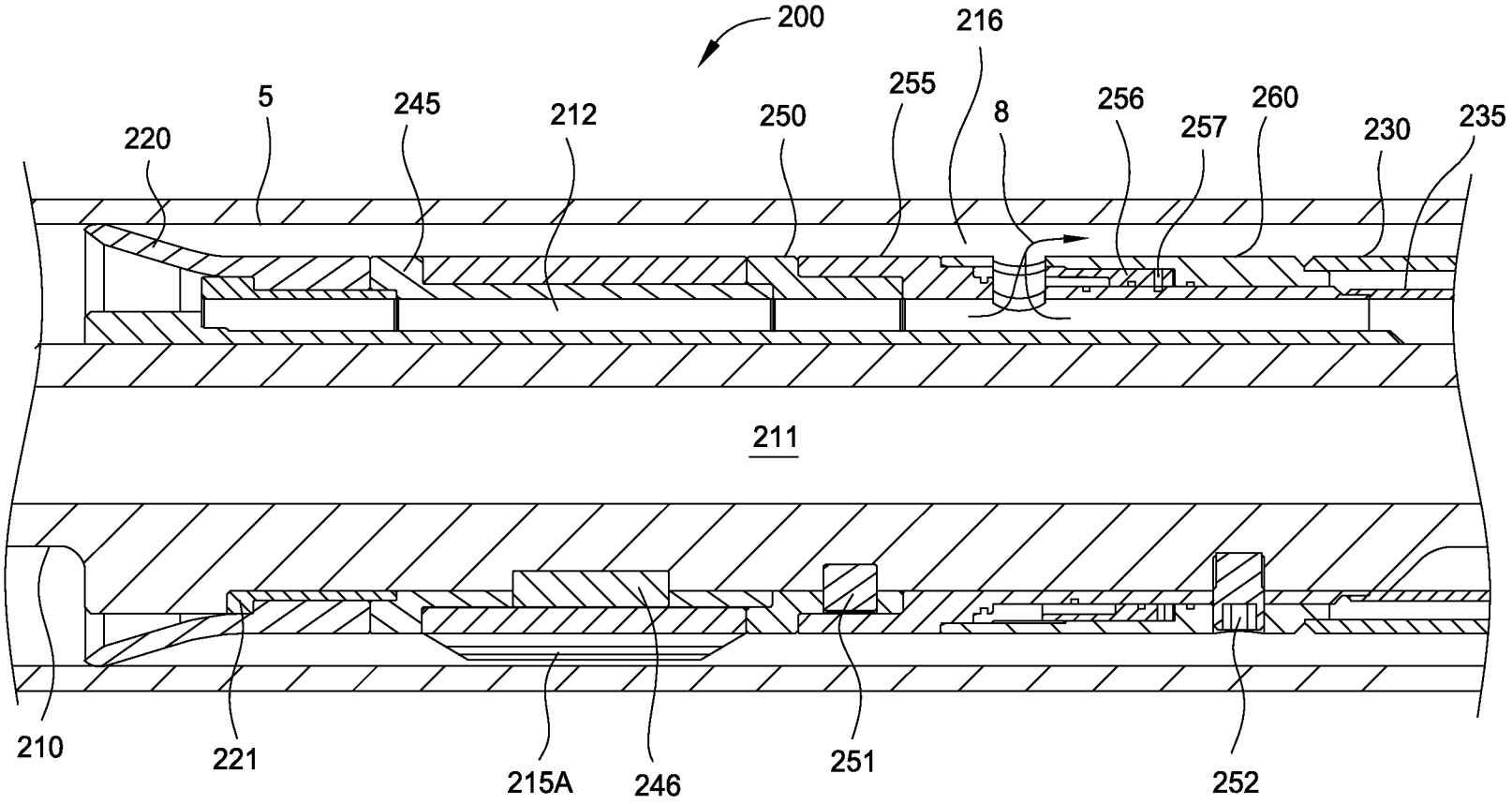
FIGS. 6A and 6B illustrate partial sectional views of the downhole tool according to one embodiment.

Referring to FIG. 6A, if the pressure within the flow paths 212 exceeds a predetermined amount, the pressurized fluid may force the piston 256 to shear the shearable members 257 and open a pressure relief fluid path disposed through the bypass seat 255 and the bypass housing 260, illustrated by reference arrow 8, to allow the fluid to flow out of the tool 200 into the flow paths 216. For example, the pressure increase within the flow paths 212 may be caused by filtered debris build up within the filter member 235 such that the debris substantially restricts flow through the openings 236 in the filter member 235. In addition to the piston 256, and/or as an alternative, the one or more rupture disks 265 illustrated in FIG. 3C may be ruptured by the pressure increase of the pressurized fluid when exceeding a predetermined amount to allow fluid flow out of the tool 200. In one embodiment, the piston 256 may be resettable downhole. A biasing member, such as a spring, may be used as an alternative to the shearable members 257 to control opening of the piston 256. The biasing member may move the piston 256 back to the closed position when the pressure within the tool 200 falls below a predetermined amount. In addition to the piston 256, or alternatively, the cup member 220 can be designed to "fold over" in the case of excessive overpressure from above, for example due to the filter member 235 being filled with debris. Specifically, the upper or top end of the cup member 220 can be forced outward and folded downward such that fluid flowing in the flow paths 214 can flow across the cup member 220 directly into flow paths 216 (the flow paths 214, 216 labeled in FIG. 4A). The cup member 220 folds over to allow fluids to flow or move across the exterior of the cup member 220 when the flowing toward or encountered by the upper or top end of the cup member 220. This "fold over" design of the cup member 220 acts as a pressure relief mechanism.

Figure 6B:
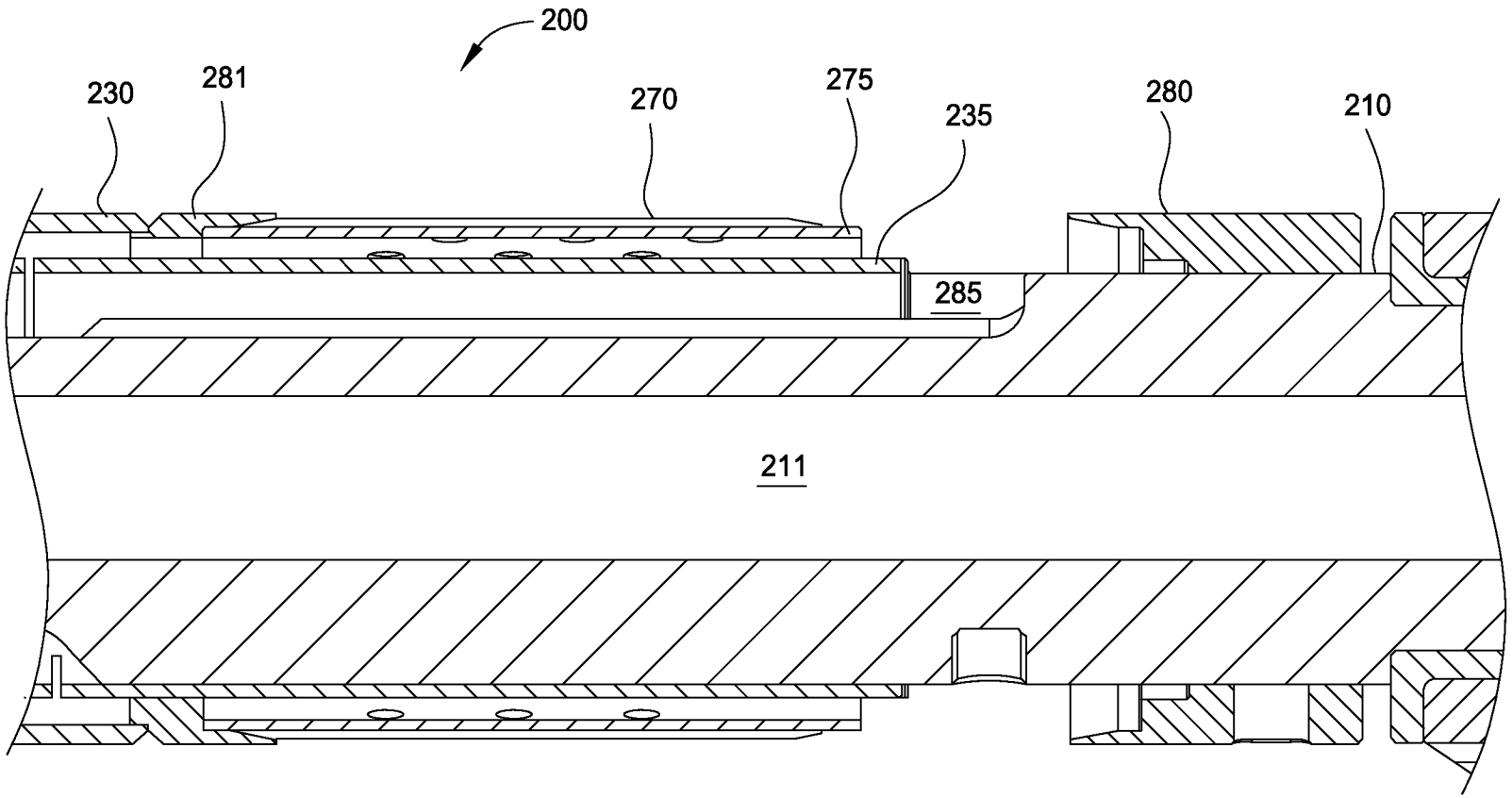

Referring to FIG. 6B, upon removal of the tool 200 from the wellbore, the plug member 280 may be moved to allow access to the debris collection area 285 and the flow paths 212, 213 to remove the captured debris and clean out the filter member 235. The pin member 253 may be removed, and the plug member 280 may be moved along the inner mandrel 210 away from the filter member 235 to provide immediate and easy access to the debris collection area 285. A cleaning fluid can be injected into the tool 200 to flush out any debris in the flow paths 212, 213, the filter member 235, and/or the debris collection area 285.

Figure 7:
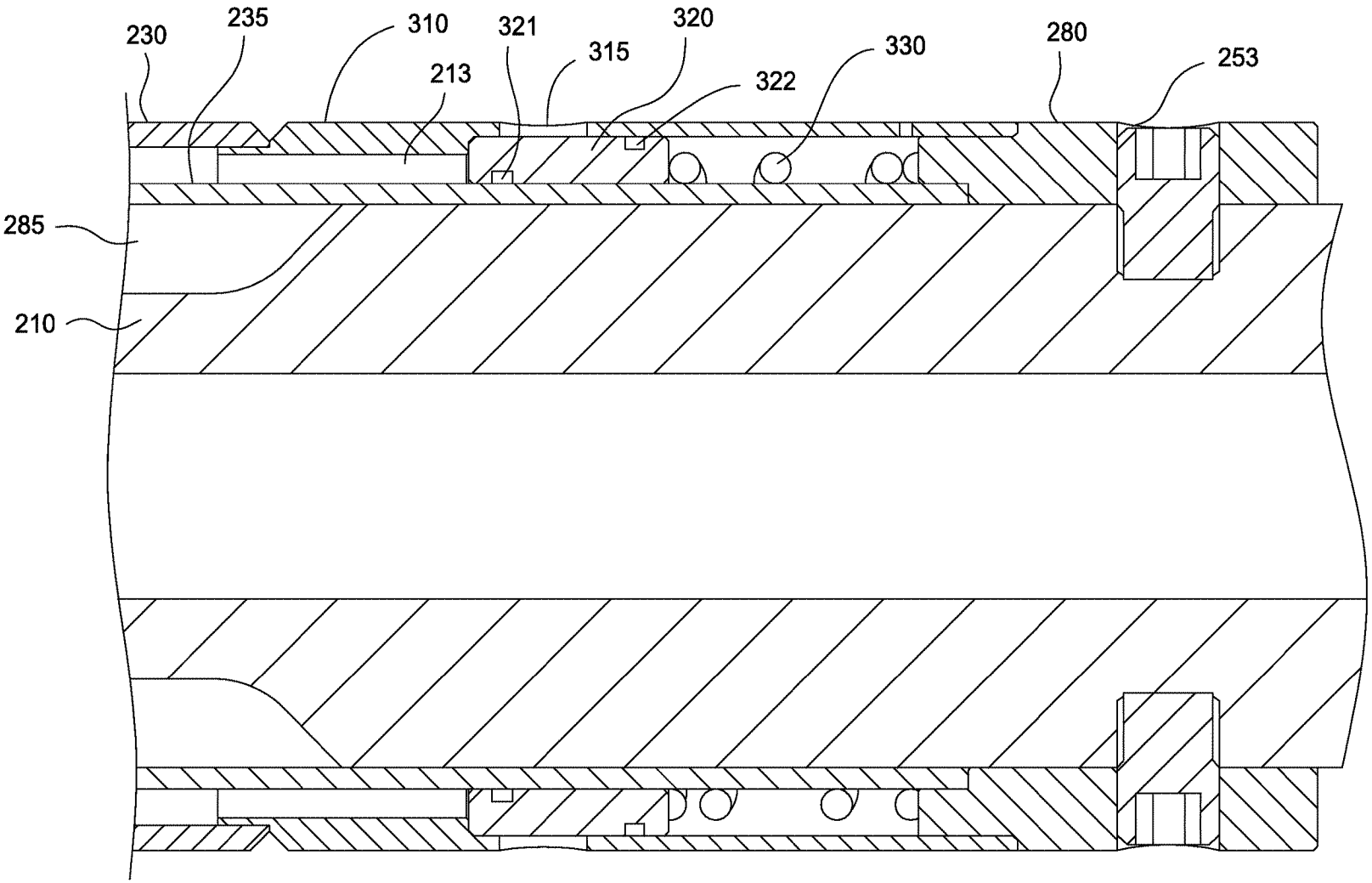
FIG. 7 illustrates a partial sectional view of the downhole tool according to one embodiment.

FIG. 7 illustrates another embodiment of the tool 200. In particular, instead of the flexible baffle 270 and the support member 275, the tool 200 may comprise a lower housing 310, a piston 320, a biasing member 330 to permit filtered fluid flow out of the tool 200 while preventing fluid flow into the tool 200. The lower housing 310 may be coupled to the filter sleeve 230 and the plug member 280. The piston 320 may be disposed between the lower housing 310 and the end of the filter member 235. The biasing member 330 may engage the plug member 280, and may bias the piston 320 into engagement with an inner shoulder of the lower housing 310. One or more seals 321, 322 may be provided between the lower housing 310, the piston 320, and the filter member 235 interfaces.

As illustrated in FIG. 7, the piston 320 is biased into a closed position to substantially close fluid communication between the flow paths 213 and a fluid outlet 315, such as a plurality of holes, of the lower housing 310. The pressurized filtered fluid in the flow paths 213 may force the piston 320 against the bias of the biasing member 330 to allow fluid flow out of the tool 200. When the pressure of the filtered fluid in the flow paths 213 is less than the bias force of the biasing member 330, the piston 320 is moved to the closed position to prevent fluid from flowing into the tool 200 via the fluid outlets 315. The piston 320 thus similarly acts as a check valve like the flexible baffle 270 and the support member 275 described above.

While the foregoing is directed to embodiments of the invention, other and further embodiments of the invention may be devised without departing from the basic scope thereof, and the scope thereof is determined by the claims that follow.

We claim:

1. A wellbore cleaning tool, comprising:

an inner mandrel;

a cup member coupled to the inner mandrel, wherein the cup member is moveable between a collapsed position where fluid may flow across the exterior of the cup member, and an extended position where fluid is diverted into a first flow path disposed between the inner mandrel and the cup member;

a filter member coupled to the inner mandrel below the cup member;

a filter housing disposed around the filter member;

a second flow path disposed between the filter housing and the filter member;

one or more openings in the filter member configured to provide fluid communication between the first flow path and the second flow path, wherein the second flow path is located downstream from the one or more openings; and a one way valve defining an exit for the second flow path.

2. The tool of claim 1, further comprising a piston coupled to the inner mandrel by a shearable member, wherein the piston is movable upon release of the shearable member to open fluid communication between the first flow path and the exterior of the tool.

3. The tool of claim 1, further comprising an outer housing coupled to the inner mandrel, and one or more rupture disks coupled to the outer housing, wherein the rupture disks are configured to open fluid communication between the first flow path and the exterior of the tool.

4. The tool of claim 1, wherein the one way valve comprises a support member having one or more openings in fluid communication with the second flow path, and a baffle coupled to the support member and having one or more openings that are offset from the opening of the support member.

5. The tool of claim 4, wherein the baffle is formed from a flexible material to allow fluid from the second flow path to flow through the openings of the support member and radially flex the baffle to allow the fluid to flow through the openings of the baffle.

6. The tool of claim 5, wherein the openings in the baffle comprise a plurality of holes or longitudinal slots, and wherein the openings in the support member comprise a plurality of holes.

7. The tool of claim 1, further comprising a lower housing coupled to the inner mandrel, and a piston disposed between the lower housing and the inner mandrel, wherein the piston is biased into a closed position to close fluid communication between the second flow path and the exterior of the tool.

8. The tool of claim 7, wherein the piston is movable to an open position to open fluid communication between the second flow path and the exterior of the tool.

9. The tool of claim 1, wherein the filter housing is disposed around an exterior of the filter member, and the second flow path is an annular flow path disposed between the filter housing and the filter member.

10. The tool of claim 1, further comprising a collection area disposed between the filter housing and the inner mandrel.

11. The tool of claim 1, wherein a support member is disposed around the exterior of the filter member.

12. A method of removing debris from a fluid in a wellbore using a wellbore cleaning tool, comprising:

positioning the tool within the wellbore, wherein the fluid is disposed in a flow path formed between an exterior of the tool and the wellbore;

flowing the fluid towards a first side of a cup member of the tool or moving the first side of the cup member through the fluid;

allowing the fluid to flow or move across an exterior of the cup member when the fluid flows toward or is encountered by a bottom end of the cup member;

preventing the fluid from flowing or moving across the exterior of the cup member when the fluid flows toward or is encountered by a top end of the cup member;

diverting the fluid disposed above the cup member into the interior of the cup member;

flowing the fluid through a filter member of the tool to remove debris from the fluid; and flowing the fluid leaving the filter member through a one way valve to exit the tool and back into the flow path formed between the exterior of the tool and the wellbore and on a second side of the cup member.

13. The method of claim 12, further comprising moving the cup member into engagement with the wellbore using the fluid when flowing towards or encountered by the top end of the cup member.

14. The method of claim 12, further comprising biasing the cup member into engagement with the wellbore.

15. The method of claim 12, wherein the cup member has an outer diameter that is greater than or substantially equal to an inner diameter of the wellbore.

16. The method of claim 12, further comprising collapsing the cup member using the fluid when flowing towards or encountered by the bottom end of the cup member.

17. The method of claim 12, further comprising biasing the cup member away from engagement with the wellbore.

18. The method of claim 12, wherein the cup member has an outer diameter that is less than an inner diameter of the wellbore, and further comprising forcing the cup member outward into engagement with the wellbore using the fluid.

19. The method of claim 12, wherein the one way valve comprises a flexible baffle coupled to a support member, wherein the flexible baffle comprises one or more openings that are offset from one or more openings in the support member, and further comprising flowing the fluid through the openings of the support member, and radially flexing the flexible baffle to allow the fluid to flow out through the openings of the flexible baffle.

20. The method of claim 12, wherein the one way valve comprises a piston biased into a closed position to close fluid communication between an interior of the tool and the flow path formed between the exterior of the tool and the wellbore, and further comprising using the fluid to move the piston into an open position to allow the fluid to flow back into the flow path formed between the exterior of the tool and the wellbore.

21. The method of claim 12, further comprising relieving pressure within the tool using at least one of a releasable piston and a rupture disk.

22. The method of claim 12, further comprising forcing the cup member to fold over to allow fluid to flow or move across the exterior of the cup member when the fluid flows toward or is encountered by the top end of the cup member.

23. A wellbore cleaning tool, comprising:

an inner mandrel;

a cup member coupled to the inner mandrel, wherein the cup member is moveable between a collapsed position where fluid may flow across the exterior of the cup member, and an extended position where fluid is diverted into a first flow path disposed between the inner mandrel and the cup member;

a filter member coupled to the inner mandrel below the cup member;

a support member having one or more openings in fluid communication with the filter member; and a baffle coupled to the support member and having one or more openings that are offset from the one or more openings of the support member, wherein the baffle is formed from a flexible material to allow fluid from the filter member to flow through the one or more openings of the support member and radially flex the baffle to allow the fluid to flow through the one or more openings of the baffle.

24. The tool of claim 23, wherein the one or more openings in the baffle comprise a plurality of holes or longitudinal slots, and wherein the one or more openings in the support member comprise a plurality of holes.

* * * * *